US006525006B2

(12) United States Patent
Yoneta et al.

(10) Patent No.: US 6,525,006 B2
(45) Date of Patent: Feb. 25, 2003

(54) LUBRICANT COMPOSITION

(76) Inventors: Yoshiyuki Yoneta, c/o Tsujido Plant, Kyodo Yushi Co., Ltd., 4-1, Tsujido-Kandai 1-Chome, Fujisawa-Shi, Kanagawa-Ken (JP); Atsuya Ueda, c/o Tsujido Plant, Kyodo Yushi Co., Ltd., 4-1, Tsujido-Kandai 1-Chome, Fujisawa-Shi, Kanagawa-Ken (JP); Kazuyoshi Takeda, c/o Tsujido Plant, Kyodo Yushi Co., Ltd., 4-1, Tsujido-Kandai 1-Chome, Fujisawa-Shi, Kanagawa-Ken (JP)

( * ) Notice: Subject to any disclaimer, the term of this patent is extended or adjusted under 35 U.S.C. 154(b) by 0 days.

(21) Appl. No.: 10/079,851

(22) Filed: Feb. 22, 2002

(65) Prior Publication Data

US 2002/0193263 A1 Dec. 19, 2002

(30) Foreign Application Priority Data

Mar. 23, 2001 (JP) ..... 2001-084443

(51) Int. Cl.[7] ..... C10M 169/04; C10M 145/36

(52) U.S. Cl. ..... 508/517; 508/518; 508/519; 72/42

(58) Field of Search ..... 508/517, 518, 508/519; 72/42

(56) References Cited

U.S. PATENT DOCUMENTS 3,720,695 A * 3/1973 Meisters ..... 508/516
4,762,946 A * 8/1988 Ritter et al. ..... 508/516
4,906,702 A * 3/1990 Ritter et al. ..... 526/321
5,068,422 A * 11/1991 Balzer et al. ..... 508/517
5,250,203 A * 10/1993 Denis et al. ..... 508/517
5,282,987 A * 2/1994 Balzar et al. ..... 508/517
5,374,366 A * 12/1994 Nakahara et al. ..... 508/516

FOREIGN PATENT DOCUMENTS

JP 6-100875 4/1994
JP 8-239683 9/1996

* cited by examiner

*Primary Examiner*—Jacqueline V. Howard
(74) *Attorney, Agent, or Firm*—Oblon, Spivak, McClelland, Maier & Neustadt, P.C.

(57) ABSTRACT

A lubricant composition comprises (1) at least one member selected from the group consisting of carboxylic acid compounds each obtained by the addition of an oxyalkylene group to a hydroxyl group of a hydroxy carboxylic acid and alkali metal salts and amine salts thereof; and (2) at least one base oil selected from the group consisting of alkyl benzene, normal paraffin, isoparaffin and α-olefin. The lubricant composition is highly resistant to putrefaction when it is used as a metal-processing oil composition and shows excellent cutting characteristics in the metal-processing, which requires an extremely high lubricating action, such as form-rolling tap and deep hole boring. Moreover, the composition makes operations such as metal-processing operations easy since the liquid obtained by diluting it with water is transparent or translucent.

16 Claims, No Drawings

LUBRICANT COMPOSITION

BACKGROUND OF THE INVENTION

The present invention relates to a lubricant composition, which can widely be applied to metal processing such as cutting, grinding and plastic working.

As cutting oils widely used in the fields of, for instance, cutting and grinding working, there have been known a water-insoluble cutting oil composition, which mainly comprises a mineral oil, and water-soluble cutting oil composition, which comprises, for instance, a mineral oil, a surfactant and an organic amine compound and which is diluted prior to the practical use.

Regarding the cutting oil composition, there has recently been desired for the development of an oil composition, which is mild to the earth environment and can further withstand the long-term service, as compared with conventional cutting oil compositions from the recent viewpoint of the saving of natural resources and the prevention of the earth environmental pollution.

As an example of such techniques, there has been used a synthetic metal-processing oil composition, which is free of any mineral oil, for the purpose of the clarification of working environment. Such a synthetic metal-processing oil composition is advantageous in that it can maintain the transparency thereof even after the dilution thereof with water and that it has a high resistance to any decomposition or putrefaction. As conventional water-soluble metal-processing oils, there have been known, for instance, a lubricant composition comprising a hydroxy carboxylic acid-oxyalkylene adduct (see Japanese Un-Examined Patent Publication (hereunder referred to as "J. P. KOKAI") No. Hei 6-100875) and a water-soluble cutting oil composition (see J.P. KOKAI No. Hei 8-239683).

However, these conventionally known synthetic metal-processing oil compositions suffer from a problem such that they cannot, in general, be favorably used in the processing, which requires an extremely high lubricating action, such as form-rolling tap and deep hole boring.

SUMMARY OF THE INVENTION

Accordingly, it is an object of the present invention to provide a lubricant composition, which shows excellent processing characteristics when it is used as a lubricating agent for metal-processing including cutting and grinding, which is stable and can maintain its transparency even after the dilution with water, which is excellent in the resistance to decomposition or putrefaction and which does not adversely affect the environment.

The inventors of this invention have conducted various investigations, have found that a lubricating agent highly resistant to decomposition or putrefaction and accordingly suitably used in the form rolling tap and deep hole boring by the incorporation of a specific carboxylic acid or its salt and a specific synthetic oil into a lubricating agent and have thus completed the present invention.

According to the present invention, there is provided a lubricant composition, which comprises (1) at least one member selected from the group consisting of carboxylic acid compounds each obtained by the addition of an oxyalkylene group to a hydroxyl group of a hydroxy carboxylic acid and alkali metal salts and amine salts thereof; and (2) at least one base oil selected from the group consisting of alkyl benzene, normal paraffin, isoparaffin and α-olefin.

DESCRIPTION OF THE PREFERRED EMBODIMENTS

The compound used in the lubricant composition of the present invention as the component (1) is at least one member selected from the group consisting of carboxylic acid compounds each obtained by the addition of an oxyalkylene group to a hydroxyl group of a hydroxy carboxylic acid, which carries at least one hydroxyl group and at least one carboxyl group, and alkali metal salts and amine salts thereof.

The hydroxy carboxylic acid used in the present invention may be a saturated or unsaturated one and preferably has 7 to 26 carbon atoms. Examples of such hydroxy carboxylic acids are aliphatic hydroxy carboxylic acids and aromatic hydroxy carboxylic acids.

Specific examples of the aliphatic hydroxy carboxylic acids are monohydroxy monocarboxylic acids such as hydroxy pelargonic acid, hydroxy capric acid, hydroxy lauric acid, hydroxy myristic acid, hydroxy palmitic acid, hydroxy stearic acid, hydroxy arachic acid, hydroxy behenic acid, ricinoleic acid and hydroxy octadecenoic acid; monohydroxy dicarboxylic acids such as hydroxy sebacic acid and hydroxy octyldecane diacid; monohydroxy tricarboxylic acid such as norcaperatic acid and agaricic acid; dihydroxy monocarboxylic acids such as ipurolic acid, dihydroxy hexadecanoic acid, dihydroxy stearic acid, dihydroxy octadecenoic acid and dihydroxy octadecane dienoic acid; dihydroxy dicarboxylic acids such as dihydroxy dodecane diacid, dihydroxy hexadecane diacid, furoic acid and dihydroxy hexacosane diacid; trihydroxy monocarboxylic acids such as trihydroxy hexadecanoic acid (ustic acid-B) and trnhydioxy octadecanoic acid; and tetrahydroxy monocarboxylic acid such as tetrahydroxy octadecanoic acid. In addition, specific examples thereof also include castor oil fatty acids derived from naturally occurring oils and fats and hardened castor oil fatty acids.

In addition, specific examples of aromatic hydroxy carboxylic acids include hydroxy benzoic acid, dihydroxy benzoic acid, trihydroxy benzoic acid, hydroxy methyl benzoic acid, hydroxy dimethyl benzoic acid, hydroxy isopropyl benzoic acid, hydroxy isopropyl methyl benzoic acid, dihydroxy methyl benzoic acid, hydroxy phthalic acid, dihydroxy phthalic acid, trihydroxy phthalic acid, hydroxy isophthalic acid, dihydroxy isophthalic acid, trihydroxy isophthalic acid, hydroxy methyl isophthalic acid, hydroxy terephthalic acid, dihydroxy terephthalic acid, divaric acid, olivetol carboxylic acid and spherophoruric carboxylic acid.

The oxyalkylene group may preferably be oxyethylene group, oxypropylene group or mixed oxyethylene and oxypropylene groups and the molar number of the added oxyalkylene groups preferably ranges from 1 to 200 and more preferably 1 to 50.

Examples of alkali metal salts are sodium, potassium and lithium salts. For instance, the alkali metal salt may be a salt of a carboxylic acid compound obtained through a saponification reaction of an oxyalkylene adduct of castor oil.

Examples of amines constituting the amine salts include diethanolamine, tri eth anolamine, monoisoprop anolamine, triisopropanolamine, methyl diethanolamine, dimethyl ethanolamine, 2-amino-2-methyl-1-propanol, 2-(2-aminoethoxy) ethanol, diethyl monoisopropanolamine, N,N-dibutylamino-ethanol, N,N-di-n-butylamino-isopropanol, N,N-di-n-propylamino-isoprop anol, N,N-di-t-butyl diethanolamine, N,N-ethylenediamine (diisoprop anol), N ,N-ethylenediamine (diethanol), mono-n-butyl di-ethanolamine, monoethyl diisopropanolamine and 2-amino-2-methyl ethanol.

As the alkylbenzene used in the lubricant composition of the present invention as the component (2), there may be listed, for instance, monoalkylbenzenes (having a molecular weight ranging from 218 to 274) and dialkylbenzenes (having a molecular weight ranging from 358 to 470) each carrying an alkyl group having 10 to 14 (about 12) carbon atoms and specific examples thereof are decylbenzene, undecylbenzene, dodecylbenzene, tridecylbenzene, di-decylbenzene, di-undecylbenzene, di-dodecyl-benzene and di-tridecylbenzene.

The normal paraffins usable herein may be, for instance, those having about 12 to 14 carbon atoms (having a molecular weight ranging from 170 to 198) and specific examples thereof include decane, undecane, dodecane, tridecane and tetradecane. The isoparaffins usable herein may be, for instance, those carrying about 12 to 14 carbon atoms (having a molecular weight ranging from 170 to 198 and specific examples thereof are isodecane, isoundecane, isododecane, isotridecane and isotetradecane. The α-olefin usable herein may be, for instance, those having about 12 to 14 carbon atoms (having a molecular weight ranging from 168 to 196) and specific examples thereof are decene, undecene, dodecene, tridecene and tetradecene.

In the lubricant composition of the present invention, the ratio (by mass) of the component (1) to the component (2) preferably ranges from 1:20 to 20:1. This is because if the rate of the component (1) is less than the lower limit, the resulting lubricant composition is not always sufficient in the stability to the dilution with hard water, while if it is greater than the upper limit, the resulting lubricant composition is not always stable and the resulting liquid may often be in the form of a gel.

The lubricant composition of the present invention can be used as a metal-processing oil composition such as cutting oil composition and a grinding oil composition after it is blended with, for instance, a fatty acid, an amine, water, a mineral oil and/or an emulsifying agent. The lubricant composition may be used as a metal-processing oil composition without incorporation of any other component or may be used after it is diluted 5 to 200 times with water.

When the lubricant composition of the present invention is diluted before the practical use, the total content of the effective components (1) and (2) after the dilution suitably ranges from 0.5 to 10% by mass.

The lubricant composition of the present invention may, if necessary, comprise an antibacterial agent. Examples of such antibacterial agents are amines such as diethanolamine, triethanolamine, monoisopropanolamine, triisopropanolamine, methyl diethanolamine, dimethyl ethanolamine, 2-amino-2-methyl-1-propanol, 2-(2-amino-ethoxy)ethanol, diethyl monoisopropanolamine, N,N-dibutylamino-ethanol, N,N-di-n-butylamino-isopropanol, N,N-di-n-propylamino-isopropanol, N,N-di-t-butyl diethanolamine, N,N-ethylenediamine (diisopropanol), N,N-ethylenediamine (diethanol), mono-n-butyl diethanolamine, monoethyl diisopropanolamine, 2-amino-2-methyl ethanol, cyclohexylamine, dicyclohexylamine, 1,3-bisaminomethyl cyclohexane, metaxylene-diamine and morpholine; alkylamines represented by lauiylamine and oleylamine; and oxyethylene adducts thereof.

Furthermore, the lubricant composition of the present invention may, if necessary, comprise a rust-proofmig agent. Examples of such rust proofing agents include fatty acids such as caproic acid, enanthic acid, capric acid, pelargonic acid, caprylic acid, undecanoic acid, undecylenic acid, dodecanoic acid, tridecanoic acid, pentadecanoic acid, heptadecanoic acid, nonadecanoic acid, lauric acid, myristic acid, palmitic acid, stearic acid, arachic acid, behenic acid, isostearic acid, elaidic acid, oleic acid, linoleic acid, linolenic acid, erucic acid, azelaic acid, hydroxy lauric acid, hydroxy myristic acid, hydroxy palmitic acid, hydroxy stearic acid, hydroxy arachic acid, hydroxy behenic acid, ricinoleic acid, hydroxy octadecenoic acid, sebacic acid, dodecane diacid, dodecyl succinic acid, lauryl succinic acid, stearyl succinic acid, isostearyl succinic acid, dimeric acids and linoleic acid-methacrylic acid condensate (trade name: DA-1550 available from Harima Chemicals, inc.); sulfonic acid salts such as sodium petroleum sulfonate; carboxylic acid amides; alkenyl succinic acids; and carboxylic acid sarcosides.

The lubricant composition of the present invention may further comprise other additives and examples thereof are silicone type anti-foaming agents, alcohol type anti-foaming agents, triazine type preservatives, alkyl benzimidazole type preservatives or metal rust proofing agents, benzothiazole type metal rust proofing agents, nonionic surfactants such as polyoxyethylene alkyl ether, polyoxyethylene alkyl phenyl ether and carboxylic acid alkanolamides, coupling agents such as polyhydric alcohols, glycols and water, inorganic salts such as phosphates, carbonates, borates and silicates, metal-chelating agents such as EDTA, and oiliness improving agents such as oxidization waxes, naturally occurring oils and fats, synthetic oils and fats, synthetic esters and high molecular weight polymers.

The total amount of these additives in general ranges from 1:20 to 20:1 as expressed in terms of the ratio by mass with respect to the foregoing effective components, provided that the amount of water is omitted.

The present invention will hereunder be described in more detail with reference to the following working Examples and Comparative Examples, but the present invention is not restricted to these specific Examples at all.

EXAMPLES 1 to 9 and COMPARATIVE EXAMPLES 1 to 3

Preparation of Saponified Product I

To 750 g of castor oil-oxyethylene adduct (added amount of oxyethylene: one mole), there were added 250 g of potassium hydroxide and 250 g of water and then the resulting mixture was stirred for 3 hours at 80° C. to thus give a saponified product I of the castor oil-oxyethylene adduct.

Preparation of Saponified Product II

To 750 g of castor oil-oxyethylene adduct (added amount of oxyethylene: 10 moles), there were added 125 g of potassium hydroxide and 250 g of water and then the resulting mixture was stirred for 3 hours at 80° C. to thus give a saponified product II of the castor oil-oxyethylene adduct.

Preparation of Saponified Product III

To 750 g of hardened castor oil-oxyethylene adduct (added amount of oxyethylene: 10 moles), there were added 125 g of potassium hydroxide and 250 g of water and then the resulting mixture was stirred for 3 hours at 80° C. to thus give a saponified product III of the hardened castor oil-oxyethylene adduct.

Preparation of Saponified Product IV

To 750 g of castor oil-oxyethylene/oxypropylene adduct (added amount of oxyethylene: 34 moles; added amount of oxypropylene: 8 moles), there were added 50 g of potassium hydroxide and 250 g of water and then the resulting mixture was stirred for 3 hours at 80° C. to thus give a saponified product IV of the castor oil-oxyethylene/ oxypropylene adduct.

Ingredients specified in the following Table 1 were blended in a mixing ratio specified in Table 1 to give each corresponding lubricant composition. In Table 1, the amount of each ingredient is expressed in terms of "% by mass".

Test Methods

Test for Evaluating Stability to Dilution with Hard Water

Conditioned hard water (an aqueous solution prepared by diluting 0.757 g of calcium chloride dihydrate with distilled water to a total volume of one liter: German Hardness of 30°; Ca hardness of 540 ppm; see "Cutting Oil Composition, Emulsion Stability Test" specified in JIS K-2221) was used to prepare a diluted liquid of each water-soluble metal-processing oil composition having each corresponding composition specified in Table 1 and a concentration of 2% by mass. Then the diluted liquid was visually inspected for the condition immediately after the preparation and after 24 hours from the preparation and evaluated according to the following criteria: Judgement: ○:Acceptable, Transparent or Translucent Em: Unacceptable, Milky White Test for Cutting Characteristics Each water-soluble metal-processing oil composition having each corresponding composition specified in Table 1 was diluted 10 times with tap water to give 200 L of each corresponding diluted liquid having a concentration of 10% by mass. The resulting liquid was applied to a coolant tank of a machining center and a cutting test was conducted under the following cutting conditions to thus evaluate or judge the quality of the processed plane after reaming.

Various Factors for Cutting

An aluminum alloy (AC8B-T6; 300×200×30 mm; $H_R$B60) was used as an test material, a blind hole having a prepared hole of 5.45ϕ was formed and a test for examining cutting characteristics was conducted using M6 Tap (Newroll Tap B-NRT available from OSG).

Conditions for Tapping:

Cutting Speed: 10 m/min

Feed: 1 mm/rev

Cutting Length: t=17 mm (blind hole)

N Value: 5

Each diluted lubricant composition was fed at an oil supply rate of 6 liter/min.

The cutting characteristics of each lubricant composition were evaluated by the visual observation thereof according to the following criteria:

A: Cutting Resistance=not more than 200 N·cm acceptable

B: Cutting Resistance=not more than 500 N·cm acceptable

C: Deposition occurred (no cutting operation possible) unacceptable

Test for Antiseptic Properties

The following septic liquid (3% by mass) was added to 100 ml of each liquid obtained by diluting the water-soluble metal-processing oil composition having the composition specified in the following Table 1 to a concentration of 3% by mass with tap water, the resulting mixture was subjected to shaking culture at 30° C. and 150 rpm for 7 days and then the viable cell count observed for each mixture was determined.

Septic Liquid:

A septic liquid used herein was obtained by subjecting the following components to aeration over 24 hours for the activation thereof:

| | |
|---|---|
| An emulsion type cutting liquid deteriorated by putrefaction | 50% by mass |
| Trypto-soy culture medium | 25% by mass |
| Dextrose-peptone culture medium | 25% by mass |

Evaluation Criteria: The number of bacterial cells present in 1 ml of each sample or the degree of pollution was evaluated by SAN-AI BIOCHECKER (available from SAN-AI Petroleum Co., Ltd.) according to the following 8 ranks:

no, $10^3$ cells >, $10^3$ cells, $10^4$ cells, $10^5$ cells, $10^6$ cells, $10^7$ cells, $10^7$ cells <.

TABLE 1

| | Example | | | | | | | | | Comp. Ex. | | |
|---|---|---|---|---|---|---|---|---|---|---|---|---|
| | 1 | 2 | 3 | 4 | 5 | 6 | 7 | 8 | 9 | 1 | 2 | 3 |
| Saponified Product I | 30 | 30 | — | — | — | 10 | — | — | — | 30 | 30 | — |
| Saponified Product II | — | — | 30 | — | — | — | 10 | 10 | 10 | — | — | — |
| Saponified Product III | — | — | — | 30 | — | — | — | — | — | — | — | — |
| Saponified Product IV | — | — | — | — | 30 | — | — | — | — | — | — | — |
| Alkylbenzene | 20 | 10 | 10 | 10 | 10 | 10 | 10 | — | 5 | — | — | 20 |
| Normal Paraffin | — | — | — | — | — | — | — | — | 5 | — | — | — |
| α-olefin | — | — | — | — | — | — | — | 10 | — | — | — | — |
| Mineral Oil | — | — | — | — | — | — | — | — | — | 20 | — | — |
| Mono-iso-propanol amine | 5 | 5 | 5 | 5 | 5 | 5 | 5 | 5 | 5 | 5 | 5 | 5 |
| Methyl diethanolamine | 10 | 10 | 10 | 10 | 10 | 10 | 10 | 10 | 10 | 10 | 10 | 10 |
| Pelargonic Acid | 8 | 8 | 8 | 8 | 8 | 8 | 8 | 8 | 8 | 8 | 8 | 8 |
| Oleic Acid | 5 | 5 | 5 | 5 | 5 | 5 | 5 | 5 | 5 | 5 | 5 | 5 |
| Laurylamine-EO Adduct | 3 | 3 | 3 | 3 | 3 | 3 | 3 | 3 | 3 | 3 | 3 | 3 |
| Water | 19 | 29 | 29 | 29 | 29 | 49 | 49 | 49 | 49 | 19 | 39 | 49 |
| Test for Stability to Dilution with Hard Water | ○ | ○ | ○ | ○ | ○ | ○ | ○ | ○ | ○ | Em | ○ | ○ |
| Test for Cutting Characteristics | A | A | B | B | B | B | B | B | B | B | C | C |
| Resistance to Putrefaction (viable count) | $10^3$ | $10^3$ | $10^3$ | $10^3$ | $10^3$ | $10^3$ | $10^3$ | no | $10^3$ | $10^7$ | $10^3$ | $10^3$ |

The compositions of the present invention prepared in Examples 1 to 9 are excellent in the stability to dilution, cutting characteristics and resistance to putrefaction. Contrary to this, the composition prepared in Comparative Example 1 wherein mineral oil is substituted for the specific base oil used in the present invention is inferior in not only the stability to dilution, but also the resistance to putrefaction. Moreover, in the compositions prepared in Comparative Examples 2 and 3, which are free of either the specific carboxylic acid or the specific base oil, the cutting characteristics are insufficient.

As has been described above in detail, the lubricant composition of the present invention is highly resistant to putrefaction when it is used as a metal-processing oil composition and shows excellent cutting characteristics in the metal-processing, which requires an extremely high lubricating action, such as form-rolling tap and deep hole boring. Moreover, the composition makes operations such as metal-processing operations easy since the liquid obtained by diluting it with water is transparent or translucent.

What is claimed is:

1. A lubricant composition comprising (1) at least one member selected from the group consisting of carboxylic acid compounds each obtained by the addition of an oxyalkylene group to a hydroxyl group of a hydroxy carboxylic acid and alkali metal salts and amine salts thereof, and (2) at least one base oil selected from the group consisting of alkyl benzene, normal paraffin, isoparaffin and α-olefm.

2. The lubricant composition of claim 1, wherein the oxyalkylene group is an oxyethylene group or a mixed oxyethylene-oxypropylene group and the added molar number of the group ranges from 1 to 200.

3. The lubricant composition of claim 1, wherein the hydroxy carboxylic acid is one having 7 to 26 carbon atoms.

4. The lubricant composition of claim 1, wherein the oxyalkylene group is an oxyethylene group or a mixed oxyethylene-oxypropylene group and the added molar number. of the group ranges from 1 to 200 and the hydroxy carboxylic acid is one having 7 to 26 carbon atoms.

5. The lubricant composition of claim 1, wherein the hydroxy carboxylic acid is castor oil fatty acid or hardened castor oil fatty acid.

6. The lubricant composition of claim 1, wherein the hydroxy carboxylic acid is castor oil fatty acid or hardened castor oil fatty acid, the oxyalkylene group is an oxyethylene group or a mixed oxyethylene-oxypropylene group and the added molar number of the group ranges from 1 to 200.

7. The lubricant composition of claim 1, wherein the hydroxy carboxylic acid is castor oil fatty acid or hardened castor oil fatty acid and the hydroxy carboxylic acid is one having 7 to 26 carbon atoms.

8. The lubricant composition of claim 1, wherein the base oil is an alkylbenzene.

9. The lubricant composition of claim 1, wherein the base oil is an alkylbenzene, the oxyalkylene group is an oxyethylene group or a mixed oxyethylene-oxypropylene group and the added molar number of the group ranges from 1 to 200.

10. The lubricant composition of claim 1, wherein the base oil is an alkylbenzene and the hydroxy carboxylic acid is one having 7 to 26 carbon atoms.

11. The lubricant composition of claim 1, wherein the base oil is an alkylbenzene and the: hydroxy carboxylic acid is castor oil fatty acid or hardened castor oil fatty acid.

12. The lubricant composition of claim 1, wherein the ratio, by mass, of the component (1) to the component (2) ranges from 1:20 to 20:1.

13. The lubricant composition of claim 1, wherein the ratio, by mass, of the component (1) to the component (2) ranges from 1:20 to 20:1, the oxyalkylene group is an oxyethylene group or a mixed oxyethylene-oxypropylene group and the added molar number of the group ranges from 1 to 200.

14. The lubricant composition of claim 1, wherein the ratio, by mass, of the component (1) to the component (2) ranges from 1:20 to 20:1 and the hydroxy carboxylic acid is one having 7 to 26 carbon atoms.

15. The lubricant composition of claim 1, wherein the ratio, by mass, of the component (1) to the component (2) ranges from 1:20 to 20:1 and the hydroxy carboxylic acid is castor oil fatty acid or hardened castor oil fatty acid.

16. The lubricant composition of claim 1, wherein the ratio, by mass, of the component (1) to the component (2) ranges from 1:20 to 20:1 and the base oil is an alkylbenzene.

* * * * *

UNITED STATES PATENT AND TRADEMARK OFFICE

CERTIFICATE OF CORRECTION

PATENT NO. : 6,525,006 B2 
DATED : February 25, 2003
INVENTOR(S) : Yoneta et al.

It is certified that error appears in the above-identified patent and that said Letters Patent is hereby corrected as shown below:

Title page,
Item [76], Inventor, should be corrected to read:
-- [75] Inventors: Yoshiyuki Yoneta; Atsuya Ueda;
Kazuyoshi Takeda, all of
Fujisawa-shi (JP) --

Insert Item [73], Assignee listed as:
-- [73] Assignee: Kyodo Yushi Co., Ltd.; Tokyo (JP) --

Signed and Sealed this

First Day of July, 2003

JAMES E. ROGAN
*Director of the United States Patent and Trademark Office*